US006636106B2

(12) United States Patent
Kohsiek

(10) Patent No.: US 6,636,106 B2
(45) Date of Patent: Oct. 21, 2003

(54) ARRANGEMENT FOR FORMING THE RECIPROCAL VALUE OF AN INPUT CURRENT

(75) Inventor: Cord-Heinrich Kohsiek, Ellerau (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/188,129

(22) Filed: Jul. 2, 2002

(65) Prior Publication Data

US 2003/0006828 A1 Jan. 9, 2003

(30) Foreign Application Priority Data

Jul. 3, 2001 (DE) ..... 101 32 217

(51) Int. Cl.[7] ..... G05F 1/10
(52) U.S. Cl. ..... 327/538
(58) Field of Search ..... 327/530, 534, 327/535, 537, 538, 539, 540, 541, 542, 543

(56) References Cited

U.S. PATENT DOCUMENTS 5,757,226 A * 5/1998 Yamada et al. ..... 327/541
6,388,495 B1 * 5/2002 Roy et al. ..... 327/309
6,452,419 B1 * 9/2002 Ovens ..... 326/80

* cited by examiner

*Primary Examiner*—Jeffrey Zweizig
(74) *Attorney, Agent, or Firm*—Steven B. Biren

(57) ABSTRACT

The invention relates to an arrangement for forming a reciprocal value of an input current (Iin), comprising: a power supply source (22); a current source (21) for generating a current (I0) for adjusting at least one operating point; a diode circuit with two devices operating as diodes (30, 31 and Q1, Q2), which are coupled in series; a transistor (Q3), in which a base of the transistor (Q3) is coupled between the diode circuit and the current source and in which a collector of the transistor (Q3) is coupled between the current source and the power supply source; and a further transistor (Q4), in which a base of the further transistor (Q4) is coupled to an emitter of the transistor (Q3) and an input current terminal and in which an emitter of the further transistor (Q4) is connected to the input current terminal of the diode circuit and the power supply source in such a way that an output current (Iout) flowing through the collector of the further transistor (Q4) is proportional to the reciprocal value of the amount of an input current (Iin) supplied via the input current terminal.

3 Claims, 2 Drawing Sheets

ARRANGEMENT FOR FORMING THE RECIPROCAL VALUE OF AN INPUT CURRENT

The invention relates to the field of analog circuits.

In connection with control and drive circuits, it is often necessary to process an input current in such a way that an output current has a value which is proportional to the reciprocal value of the input current, while the product of the input and output current should be constant. Such a requirement is connected, for example, with the linearization of characteristic curves or control circuits for capacity diodes.

FIG. 1 shows a known circuit arrangement with which the desired coherence between the input current and the output current can be realized. The input current is supplied as an input signal to an input 1 of a multiplier device 2. The output 3 of the multiplier device 2 is compared in a control circuit 4 with a predetermined nominal signal. The nominal signal is applied via a non-inverting input 5 to the control circuit 4, while the output 3 of the multiplier device 2 is connected to an inverting input 6 of the control circuit 4. The result of the comparison at the output 7 of the control circuit 4 is applied as a second input signal via a further input 8 of the multiplier device 2. In the case of a deviation of the output 3 from the nominal signal, a control signal is generated by means of the control circuit 4, which control signal controls the multiplier device 2 in such a way that the control tracks the further input 8 until the product of the input signals of the multiplier device 2 corresponds to the nominal signal. The signal applied via the inverting input 6 to the control circuit 4 is then the output signal of the control circuit 4 which is combined with the input current in the desired manner.

It is an object of the present invention to provide an arrangement for forming a reciprocal value of an input current with simple circuit means.

According to the invention, this object is achieved by an arrangement for forming a reciprocal value of an input current, which arrangement comprises the following elements: a power supply source; a current source for generating a current for adjusting at least one operating point; a diode circuit with two devices operating as diodes, which are coupled in series; a transistor, in which a base of the transistor is coupled between the diode circuit and the current source and in which a collector of the transistor is coupled between the current source and the power supply source; and a further transistor, in which a base of the further transistor is coupled to an emitter of the transistor and an input current terminal and in which an emitter of the further transistor is connected to the input current terminal of the diode circuit and the power supply source in such a way that an output current flowing through the collector of the further transistor is proportional to the reciprocal value of the amount of an input current supplied via the input current terminal.

In the arrangement described, simple electronic components which can be manufactured in a cost-efficient way are used so that a circuit arrangement which can be manufactured with a small number of components at low cost is obtained for forming a reciprocal value of an input current which, in connection with different applications, can easily be used as an integrated circuit.

The diode circuit may be formed by two diodes or two transistors, the latter corresponding to the conventional realization of a diode function in integrated circuits. As regards the electrical properties and functions, both embodiments of the diode circuit are equivalent.

The implementation of the diode circuit by means of two transistors has the advantage of a better compensation of the temperature influence on component parameters due to identical behavior of similar components in the case of temperature changes.

These and other aspects of the invention are apparent from and will be elucidated with reference to the embodiments described hereinafter.

Figure 1:
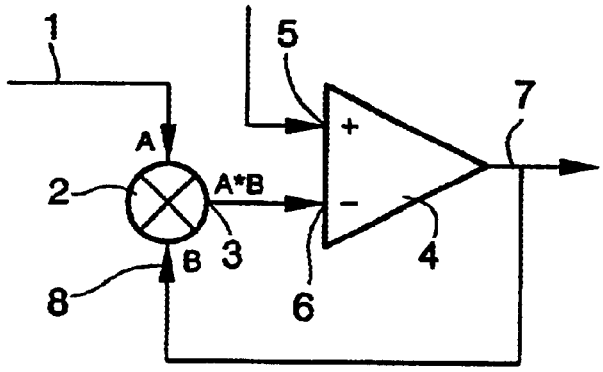
Fig. 1 PRIOR ART
FIG. 1 shows a known circuit for forming a reciprocal value.
Figure 2:
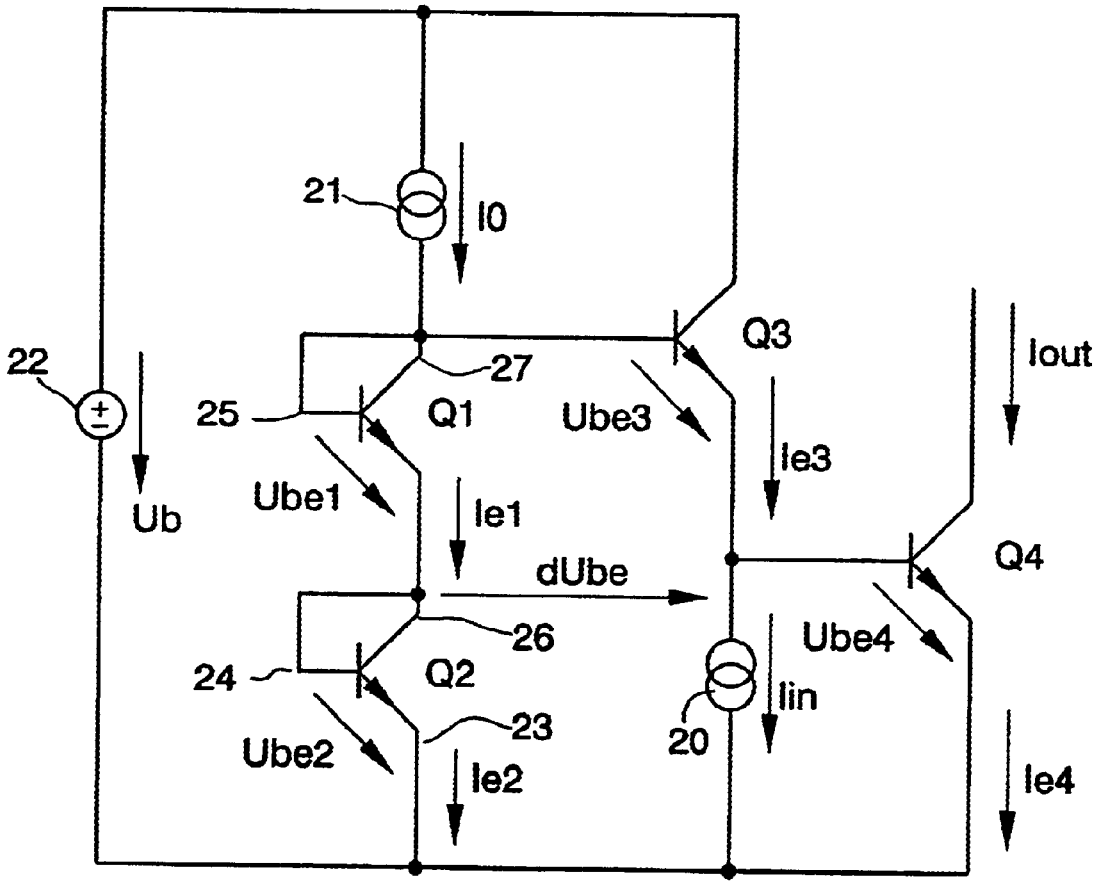
FIG. 2 shows a circuit arrangement with a diode circuit for forming a reciprocal value in dependence upon an input current, in which the diode circuit comprises two transistors.

FIG. 2 shows a circuit arrangement for forming a reciprocal value of an input current Iin. In FIG. 2, the input current or input signal Iin is supplied by means of a current source 20. The circuit arrangement shown in FIG. 2 comprises a further current source 21 for generating a base current I0. A base voltage for a transistor circuit comprising transistors Q3 and Q4 is generated by means of the base current I0. The base voltage is generated by means of a diode circuit which comprises two transistors Q1 and Q2 in the embodiment shown in FIG. 2.

A power supply voltage Ub is provided by a power supply device 22. The power supply device 22 is connected to the further current source 21 and an emitter 23 of the transistor Q2. In the transistors Q1 and Q2, a base 24 and a base 25 and a collector 26 and a collector 27 are interconnected, as is shown in FIG. 2. The transistors Q1 and Q2 operate as diodes so that a diode circuit is formed.

The base current I0 is used for adjusting the currents in the circuit arrangement shown in FIG. 2, for example, the operating point, for which the input current Iin and an output current Iout are equally large, is determined by means of the base current I0. The output current Iout corresponds to a reciprocal value of the input current Iin, the value of the output current Iout being dependent on the value of the input current Iin.

In FIG. 2, the reference Ube denotes the base-emitter voltage of the transistors Q1, Q2 and Q3, Q4. Ie is the emitter current at the transistors Q1, Q2, Q3 and Q4.

For the base-emitter voltages Ube, the following relations are obtained:

$$\Delta Ube = Ube3 - Ube1 \tag{1}$$

$$\Delta Ube = Ube2 - Ube4 \tag{2}$$

Due to relation $$Ie = Iss\ exp(Ube/Ut) \tag{3}$$

it holds that $$Ube = Ut\ \ln(Ie/Iss). \tag{4}$$

By means of (4), the result from (1) and (2) is $$Ut\ \ln(I3/Ie1) = Ut\ \ln(Ie2/Ie4) \tag{5}$$

As a result, $$Ie3/Ie1 = Ie2/Ie4. \tag{6}$$

When ignoring the base currents, it holds that $$Io=Ie1=Ie2. \quad (7)$$

As a result, $$(Io)^2=Ie3\times Ie4. \quad (8)$$

So that $$Ie3\sim 1/Ie4. \quad (9)$$

Figure 3:
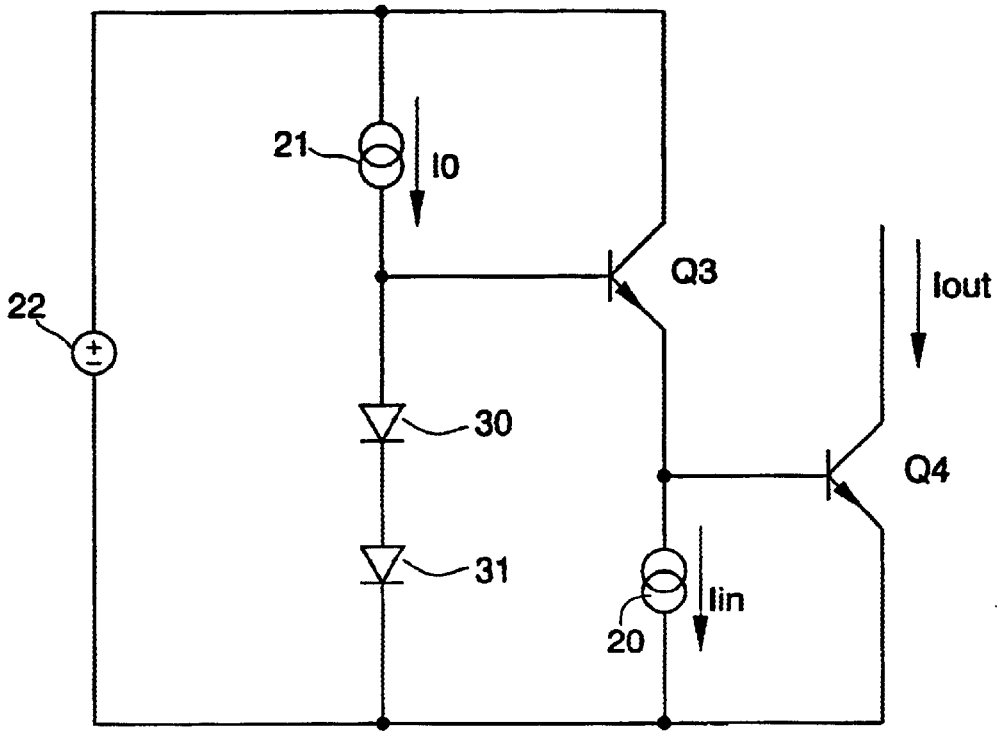
FIG. 3 shows a further circuit arrangement for forming a reciprocal value in dependence upon an input current, in which the diode circuit comprises two diodes.

FIG. 3 shows a circuit arrangement in which the two transistors Q1 and Q2 of the circuit arrangement shown in FIG. 2 are replaced by two diodes 30 and 31 for forming the diode circuit. In the circuit arrangement of FIG. 3, the output current Iout again corresponds to a reciprocal value of the input current Iin. The input current Iin flows through one of the two diodes 30 which is coupled to the second of the two diodes 31. An increase of the input current in one diode 30 increases its forward voltage by a given amount. The other diode 31 is connected to diode 30 in such a way that it reduces the forward voltage of the other diode 31 by the same amount as that by which the forward voltage of diode 30 has increased. In this case, the circuit arrangement of FIG. 3 complies with the requirement that the amounts of the input current Iin and the output current Iout should be inversely proportional to each other.

Figure 4A:
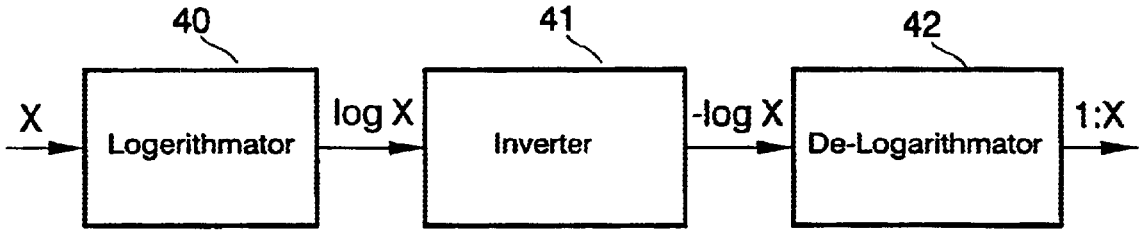
FIGS. 4A and 4B are block diagrams of elements of the circuit arrangements shown in FIGS. 2 and 3, respectively.
Figure 4B:
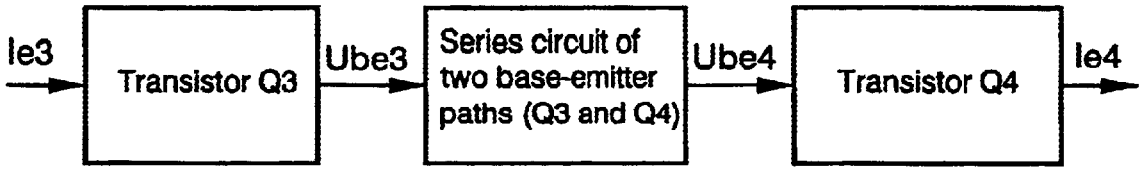

FIG. 4A is a block diagram of elements of the circuit arrangements shown in FIGS. 2 and 3. An input signal, which corresponds to the input current Iin, is logarithmated by means of a logarithmator 40. The logarithmated signal is subsequently inverted in an inverter 41. Subsequently, the logarithmated, inverted signal is delogarithmated in a delogarithmator 42. In FIG. 4B, the circuit elements of the circuit arrangements shown in FIGS. 2 and 3 are included in the blocks 40, 41 and 42 fulfilling the relevant functions. It is clear from FIG. 4 that the transistor Q3 takes over the function of the logarithmator 40. The output signal of the transistor Q3 is inverted by means of the series circuit of the two transistors Q3 and Q4 so as to be subsequently delogarithmated by means of the transistor Q4.

The characteristic features of the invention disclosed in the description above, the drawings and the claims may be important both individually and in any arbitrary combination for realizing the invention in its different embodiments.

What is claimed is:

1. An arrangement for forming a reciprocal value of an input current (Iin), comprising:

a power supply source (22);

a current source (21) for generating a current (I0) for adjusting at least one operating point;

a diode circuit with two devices operating as diodes (30, 31 and Q1, Q2), which are coupled in series;

a transistor (Q3), in which a base of the transistor (Q3) is coupled between the diode circuit and the current source and in which a collector of the transistor (Q3) is coupled between the current source and the power supply source; and a further transistor (Q4), in which a base of the further transistor (Q4) is coupled to an emitter of the transistor (Q3) and an input current terminal and in which an emitter of the further transistor (Q4) is connected to the input current terminal of the diode circuit and the power supply source in such a way that an output current (Iout) flowing through the collector of the further transistor (Q4) is proportional to the reciprocal value of the amount of an input current (Iin) supplied via the input current terminal.

2. An arrangement as claimed in claim 1, characterized in that the devices of the diode circuit are formed as diodes (30, 31).

3. An arrangement as claimed in claim 1, characterized in that the devices of the diode circuit are formed as transistors (Q1, Q2) in which a collector and a base are connected together.

* * * * *